US006070989A

United States Patent [19]

Yokoyama et al.

[11] Patent Number: 6,070,989

[45] Date of Patent: Jun. 6, 2000

[54] STRUCTURE FOR SUPPORTING A GLOBE USED FOR A PORTABLE GAS LANTERN

[75] Inventors: Hiroaki Yokoyama; Toshikazu Ikarashi, both of Niigata, Japan

[73] Assignee: Snow Peak, Inc., Japan

[21] Appl. No.: 09/163,000

[22] Filed: Sep. 30, 1998

[30] Foreign Application Priority Data

Sep. 30, 1997 [JP] Japan ..... 9-266587

[51] Int. Cl.[7] ..... F21L 19/02

[52] U.S. Cl. ..... 362/186; 362/173; 362/182; 362/376

[58] Field of Search ..... 362/160, 172, 362/173, 179, 181, 182, 185, 186, 255, 358, 363, 376–378

[56] References Cited

U.S. PATENT DOCUMENTS

| | | | |
|---|---|---|---|
| 44,577 | 10/1864 | Cross | 362/376 |
| 55,839 | 6/1866 | Duburn | 362/181 |
| 1,322,231 | 11/1919 | Dean | 362/160 |
| 1,716,514 | 6/1929 | Brinkmeyer et al. | 362/173 |
| 2,178,907 | 11/1939 | Hockley | 362/376 |
| 3,835,311 | 9/1974 | Kramer | 362/376 |
| 5,782,554 | 7/1998 | Huang | 362/376 |

*Primary Examiner*—Alan Cariaso
*Attorney, Agent, or Firm*—Griffin, Butler, Whisenhunt & Szipl, LLP

[57] ABSTRACT

There is provided a globe supporting structure that supports a globe of a gas lantern which burns combustible gas discharged from a gas cartridge containing the combustible gas by means of a burner head located inside the globe, including a ventilator positioned above the globe, a plurality of wires rotatably arranged on the ventilator, each of which rotates about the ventilator, and is shaped so as to be capable of reaching a bottom surface of the globe, and a globe supporting plate that supports the globe, and is provided with first arrangement which is detachably engagable with a portion of the wires reaching the bottom surface of the globe. In accordance with the globe supporting structure, the globe can be removed easily from the globe supporting plate without breaking the globe. In addition, unlike a conventional gas lantern known in the art, the double operation of first removing the globe from the globe supporting plate and then removing the ventilator from the globe, is not required, and the globe can be removed by only one operation of releasing the engagement between the wires and the first arrangement.

9 Claims, 5 Drawing Sheets

STRUCTURE FOR SUPPORTING A GLOBE USED FOR A PORTABLE GAS LANTERN

BACKGROUND OF THE INVENTION

1. Field of the Invention

The present invention relates to a so-called outdoor, portable gas lantern, and more particularly, to a structure for supporting a globe which is one of structural components of a portable gas lantern.

2. Description of the Related Art

FIG. 1 shows an example of a conventional portable gas lantern known in the prior art. In FIG. 1, a portable gas lantern 10 is comprised of a gas cartridge 11 containing compressed combustible gas and a gas burner 12 that can freely be attached to and detached from the gas cartridge 11. The gas cartridge 11 and the gas burner 12 are assembled in a hermetically sealed state by a gasket 13.

The gas burner 12 is connected to the gas cartridge 11, and the connection is comprised of a plug fitting 14 through which combustible gas supplied from the gas cartridge 11 passes, a knob 15 connected to a gas flow adjusting spindle that adjusts the flow rate of the combustible gas passing through the plug fitting 14 by controlling the degree of opening of a gas passage formed in the plug fitting 14, a burner head 16 with a number of openings 16*a* penetrating the surface of the head, a mixing tube 17 connecting the plug fitting 14 to the burner head 16, an ignition electrode 18 for igniting a gas mixture of air and the combustible gas flowing in the mixing tube 17, and an ignition button 19 installed on the plug fitting 14 for actuating the ignition electrode 18.

In addition, an approximately hemispherical globe supporter 20 is mounted on the mixing tube 17, for installing a globe, and a globe 21 that is shaped substantially as a cylinder is engaged with the globe supporter 20. The globe 21 is open at both the upper and lower ends, and is composed of a transparent material such as transparent glass or frosted glass. A ventilator 22 is mounted at the top of the globe 21, so that the ventilator covers the top of the opening of the globe 21.

This portable gas lantern 10 is operated as follows.

First, a substantially spherical light emitting body (not illustrated) called a mantle is installed to cover the burner head 16, before the gas lantern 10 is used.

A combustible gas in a pressurized state enters into the plug fitting 14 from the gas cartridge 11, and is fed into the mixing tube 17 while the knob 15 connected to the gas flow adjusting spindle controls the gas flow. The mixing tube 17 is provided with an opening 17*a* through which external air is taken into the mixing tube 17 by a negative pressure produced when the combustible gas passes through the interior of the mixing tube 17. The combustible gas is mixed with air entering through the opening 17*a*, to produce a gas mixture of the combustible gas and air.

When the user of the lantern presses the ignition button 19 after the gas mixture enters the burner head 16, a spark discharge occurs between the ignition electrode 18 charged positively and the mixing tube 17 charged negatively, and the spark ignites the gas mixture flowing in the mixing tube 17 through the opening 17*a*. In this way, the ignited gas mixture flows out through a number of openings 16*a* formed in the surface of the burner head 16, so as to illuminate the mantle installed around the burner head 16.

As described above, the light emitting body (mantle) is illuminated by the burning combustible gas, and the gas lantern 10 can be used as a light source outdoors, for instance.

As shown in FIG. 1, the globe 21 is mounted on the globe supporter 20 by a pair of globe mounting springs 23, and the globe 21 can be freely attached to and removed from the globe supporter.

The globe mounting springs 23 are comprised of leaf springs shaped in a crank, and one end 23*a* is fixed to the inner wall of the globe supporter 20. The other end 23*b* is structured as a free end, and the globe 21 is supported by the globe supporter 20 because the free end 23*b* presses the inner wall of the globe 21 in an outward direction. The crank portion 23*c* of the globe mounting spring 23 is located outside the globe supporter 20. When the upper and lower surfaces of the crank portion 23*c* are pressed together, the free end 23*b* of the globe mounting spring 23 rotates around the crank portion 23*c*, and engagement between the free end 23*b* and the inner wall of the globe 21 is released, and as a result, the globe 21 can be removed from the globe supporter 20.

A number of arc-shaped springs 24 are provided at the bottom of the ventilator 22. The springs 24 extend outwards from the ventilator 22, enter the interior of the globe 21 through the top surface of the opening of the globe 21, and engage with the inner wall of the globe 21. Thus arranged, the ventilator 22 is supported by the globe 21.

As described above, the globe 21 is supported by the globe supporter 20 as the globe mounting springs 23 press on the inner wall of the globe 21. When the globe 21 is to be removed from the globe supporter 20, the globe mounting springs 23 do not interfere with the removal of the globe 21 because the crank portions 23*c* have been pressed and the springs have been rotated inwards from the globe 21, so the springs do not obstruct the removal of the globe 21.

When the globe 21 is reinstalled onto the globe supporter 20 after being once removed, the upper and lower surfaces of the crank portion 23*c* is pressed from both upper and lower surfaces, and while the globe mounting springs 23 are rotated inwards relative to the globe 21, the globe 21 is mounted on the globe supporter 20, and thereafter pressure on the crank portion 23*c* is released, so that the free ends 23*b* of the globe mounting springs 23 contact the inner wall of the globe 21.

At this time, if the pressure on the crank portion 23*c* is released instantaneously, the free ends 23*b* of the globe mounting springs 23 are acted upon by the whole spring force which was accumulated by the rotation of the globe mounting springs 23, therefore the inner wall of the globe 21 is instantaneously impacted by the free ends 23*b* of the globe mounting springs 23 with an extremely large force. Unfortunately, the globe 21 has been manufactured with a thin wall to give a high transmission of light. As a consequence of these factors, the globe 21 has often been cracked by the globe mounting springs 23 when the globe 21 was mounted on the globe supporter 20.

Therefore, when a consumable component, the mantle, is to be replaced in a conventional gas lantern 10 known in the prior art, the mantle cannot be replaced unless the globe 21 is removed, so there is the inconvenience of preparing a spare globe 21 at any time to cope with the breakage of the globe 21.

In addition, the ventilator 22 is also installed at the opening of the globe 21 by the springs 24 pressing on the inner wall of the top of the globe 21. Therefore, also when the ventilator 22 was removed from the globe 21, the same problem as above used to occur. In other words, because the ventilator 22 engages with the globe 21 with a large spring force, the globe 21 with a thin wall often cracks if an attempt is made to withdraw the ventilator 22 from the globe 21 with excessive force.

Furthermore, with the conventional gas lantern 10 shown in FIG. 1 as known in the art, the ventilator 22 and the globe supporter 20 are separately attached to the globe 21, so even if an attempt is made to remove the globe 21 only to clean off soot adhering to the inner wall of the globe 21, two removal operations must be performed; removal of the ventilator 22 from the globe 21, and removal of the globe 21 from the globe supporter 20.

SUMMARY OF THE INVENTION

In view of the above-mentioned problems associated with a conventional gas lantern known in the art, it is an object of the present invention to provide a gas lantern from which the globe can be removed easily without breaking the globe and the globe can be removed with only one operation.

There is provided a globe supporting structure that supports a globe of a gas lantern which burns combustible gas discharged from a gas cartridge containing the combustible gas by means of a burner head located inside the globe, including a ventilator positioned above the globe, a plurality of wires rotatably arranged on the ventilator, each of which rotates about the ventilator, and is shaped so as to be capable of reaching a bottom surface of the globe, and a globe supporting plate that supports the globe, and is provided with first means which is detachably engagable with a portion of the wires reaching the bottom surface of the globe.

In accordance with the above-mentioned globe supporting structure of a gas lantern, a plurality of wires (for example, two wires) are installed in a freely rotatable manner on a ventilator installed above the globe. When these wires are rotated about the ventilator, the wires reach a bottom surface of the globe supporting plate that supports the globe, and engage with the first means formed on the bottom surface of the globe supporting plate. In this state, the wires contact the globe along the outer surface of the globe between the ventilator and the globe supporting plate, and support the globe at its outer periphery.

In the globe supporting structure of a gas lantern, the wires engage only with the first means provided on the globe supporting plate, and the wires do not press against the globe. The wires merely contact the globe. Therefore, unlike the conventional gas lantern 10 shown in FIG. 1, the globe will not be broken at any rate when the wires are attached or removed.

On the contrary, when the wires are engaged with the first means, the wires surround the globe. Consequently, the wires act as a guard for the globe, and even when the gas lantern rolls over, the wires will hit the ground first, so that the globe can be protected from breakage.

The wires can detachably engage with the first means. Therefore, by engaging the wires with the first means, the globe can be fixed on the globe supporting plate, and when engagement between the wires and the first means is released, the globe can be removed from the globe supporting plate. In other words, either when the globe is to be mounted on the globe supporting plate or when the globe is to be removed from the plate, the user can achieve the purpose with only one operation, that is, by engaging or disengaging the wires with or from the first means, for engaging or removing the globe with or from the globe supporting plate, respectively. According to the present invention, the two removal operations required with the conventional gas lantern 10 shown in FIG. 1, that is, when the globe 21 is to be removed, the ventilator 22 is removed from the globe 21, and then the globe 21 is removed from the globe supporter 20, are no longer needed.

The first means constructed on the globe supporting plate can be structured in various ways.

For example, the first means may be provided with a protruding portion that protrudes downward, and can rotate in a vertical direction.

According to this type of the first means, the wires engage with the first means with the wires over-riding the protruding portion. Once the wires have over-ridden the protruding portion, the wires can no longer over-ride the protruding portion in the reverse direction, so the wires are fixed in place. That is, the globe is fixed to the globe supporting plate, together with the ventilator.

To disengage the wires from the first means, the protruding portion must just be pushed upwards. By pushing the protruding portion upwards, a height of the protrusion becomes relatively small, and the wires can easily override the protruding portion. Therefore, the wires are disengaged from the first means. Hence, both the globe and the ventilator are ready to be removed from the globe supporting plate.

If the first means is composed of a resilient material, the protruding portion once pushed upward can be reset in place by its own spring force, so the effectiveness of the first means increases.

Although the first means having the aforementioned protruding portion can be formed as a separate part, and mounted on the globe supporting plate, it is also possible to construct the first means as a part integrated with the globe supporting plate. More explicitly, the first means can be formed as a part of the globe supporting plate by cutting away a peripheral portion of the plate. This method can contribute to simplifying the entire structure of a gas lantern because the number of components of the gas lantern can be reduced.

As the first means, the aforementioned protruding portion can be replaced with at least one projection formed on a lower surface of the globe supporting plate. This projection can be constructed in, for example, the form of a small hemisphere.

Once the wires go over the projection, it is not possible for the wires to override the projection in the reverse direction, so both the globe and the ventilator can be fixed to the globe supporting plate by locating the wires inside the projection.

Moreover, it is also possible to make the wires easily override the projection simply by slightly lifting the wires, therefore engagement between the wires and the projection as the first means can also be easily released.

The first means can be constructed as a recess formed in a lower surface of the globe supporting plate. By engaging the wires in this recessed portion, it is possible to produce the same state as the state in which the wires are fixed after overriding the aforementioned protruding portion or projection.

In the above examples, all the wires are arranged so that the wires can be removed from the globe supporting plate. When two wires are used, for example, it is possible to fix one of the wires to the rear surface of the globe supporting plate. In this case, the wire is installed on a lower surface of the globe supporting plate so that the wire can rotate with respect to the globe supporting plate. The other wire of the two is made to be capable of engaging with any of the first means for wire engagement described above.

Thus, the globe can be mounted on the globe supporting plate by engaging only the other wire with the first means for wire engagement, or the globe can be removed from the globe supporting plate by releasing the engagement between the wire and the first means for wire engagement.

In this structure, only one pair of wires and the first means must be disengaged for removing the globe, so the globe can be removed efficiently from the globe supporting plate. In addition, the ventilator is always permanently attached to the globe supporting plate, so that the ventilator is prevented from being lost after being removed from the globe supporting plate.

Any number of wires and associated first means can be incorporated. For instance, a wire and first means can be provided at each of the diagonally opposed sides of the ventilator, or four wires and four first means for wire engagement can also be arranged in a cross shape.

An advantage of the globe supporting structure of a gas lantern according to the present invention as described above, is that the globe can be removed easily from the globe supporting plate without breaking the globe. In addition, unlike a conventional gas lantern known in the art, the double operation of first removing the globe from the globe supporting plate and then removing the ventilator from the globe, is not required, and the globe can be removed by only one operation of releasing the engagement between the wires and the first means.

The above and other objects and advantageous features of the present invention will be made apparent from the following description made with reference to the accompanying drawings, in which like reference characters designate the same or similar parts throughout the drawing.

DESCRIPTION OF THE PREFERRED EMBODIMENTS

Figure 2:
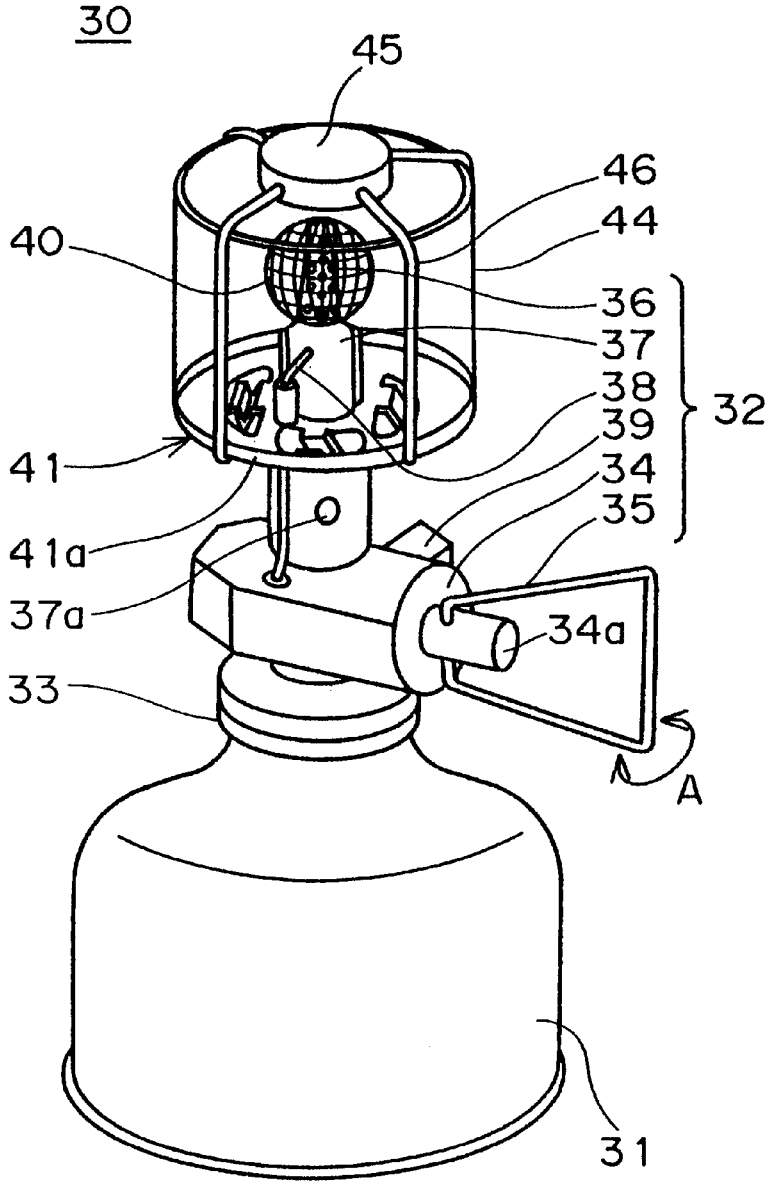
FIG. 2 is a perspective view of a gas lantern in accordance with the first embodiment in which the structure for supporting a globe in accordance with the present invention is employed.

FIG. 2 shows an example of the portable gas lantern 30 using an embodiment of the globe supporting structure according to the present invention.

The portable gas lantern 30 in this embodiment is comprised of a gas cartridge 31 filled with compressed combustible gas and a gas burner 32 mounted on this gas cartridge 31 in a freely detachable manner. The gas cartridge 31 and the gas burner 32 are connected in a hermetically sealed state, by a gasket 33.

The gas burner 32 is connected to the gas cartridge 31, and the connection is comprised of a plug fitting 34 through which combustible gas supplied from the gas cartridge 31 passes, a knob 35 connected to a gas flow adjusting spindle which is formed inside the plug fitting 34 and adjusts the velocity of the combustible gas passing through the plug fitting 34 by adjusting the degree of opening of a gas passage formed inside the plug fitting 34, a burner head 36 with a number of openings 36*a* penetrating its surface, a mixing tube 37 that connects the plug fitting 34 with the burner head 36, an ignition electrode 38 that ignites a gas mixture of air and the combustible gas, flowing in the mixing tube 37, by means of spark, and an ignition button 39 that is installed on the plug fitting 34, and actuates the ignition electrode 38.

When the gas lantern 30 is used, a substantially spherical mantle (light emitter) 40 is installed around the burner head 36.

The knob 35 is provided on the small shaft 34*a* protruding from the end of the plug fitting 34, and is allowed to rotate freely in the direction of the arrow A. In addition, inside the small shaft 34*a*, a spring (not illustrated) is installed, and even when the knob 35 is rotated in the direction of the arrow A, the knob 35 can be returned to a position parallel to the axis of the small shaft 34*a*.

As detailed later, the mixing tube 37 is provided with a globe supporting plate 41 installed at a predetermined height, and a globe 44 is mounted on the globe supporting plate 41. The globe 44 is fixed on the globe supporting plate 41 by wires extending from the ventilator 45.

Figure 1:
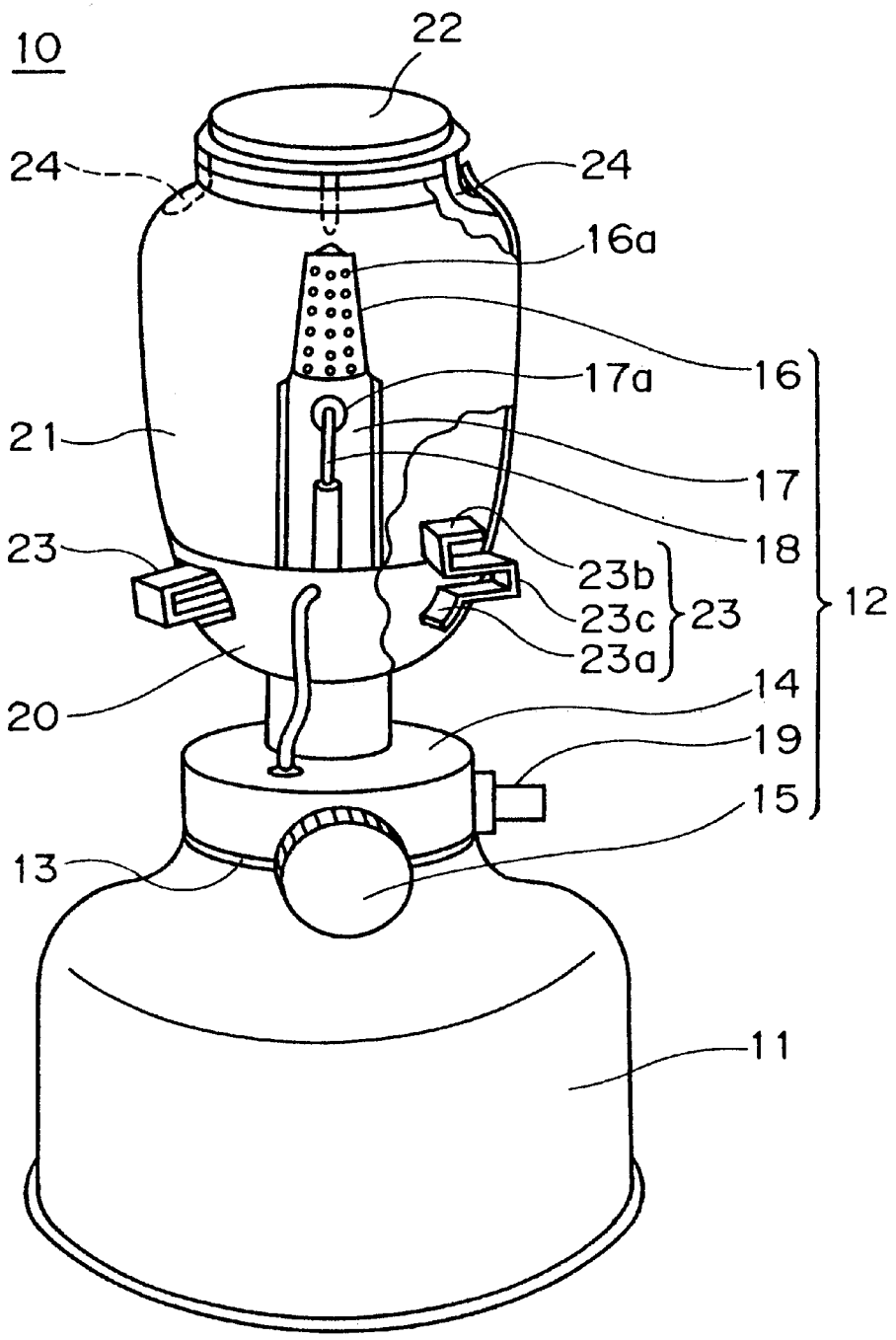
FIG. 1 PRIOR ART
FIG. 1 is a perspective view of a conventional gas lantern.

This portable gas lantern 30 functions in the same way as the conventional gas lantern 10 known in the prior art as shown in FIG. 1.

A flow of combustible gas entering the plug fitting 34 from the gas cartridge is adjusted by the knob 35 connected to the gas flow adjusting spindle, and when the gas flow is duly adjusted, the gas enters the mixing tube 37, and is mixed with air entering through an opening 37*a* in the mixing tube 37 provided beneath the globe supporting plate 41, to produce a gas mixture.

After the gas mixture enters the interior of the burner head 36, the ignition button 39 is pressed. Then a spark is produced between the ignition electrode 38 and the mixing tube 37, and the spark ignites the gas mixture flowing inside the mixing tube 37. In this way, the ignited gas mixture flows out of the plural openings formed in the surface of the burner head 36, and illuminates the mantle 40 installed around the burner head 36. Thus, the present gas lantern 30 can be used, for example, as a light source outdoors by illuminating the mantle 40.

Figure 3:
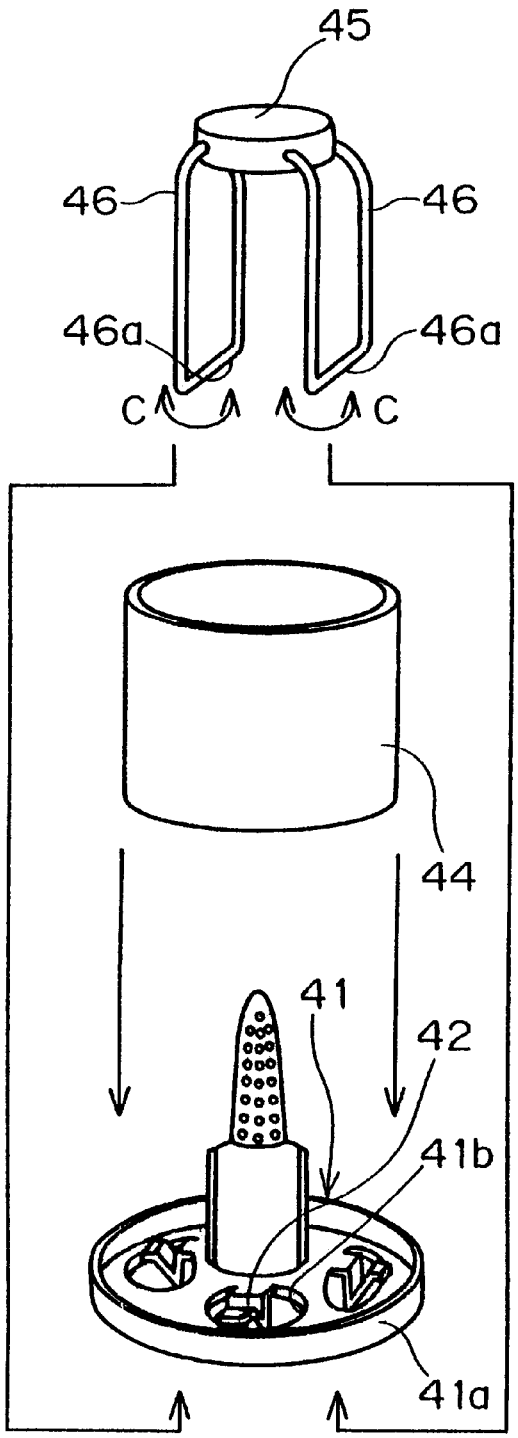
FIG. 3 is an exploded view of the structure for supporting a globe, illustrated in FIG. 2.

FIG. 3 is a disassembled view of the globe supporting plate 41, globe 44 and ventilator 45 that are components of the gas lantern 30 shown in FIG. 2. In FIG. 3, the globe supporting plate 41 installed at a predetermined height on the mixing tube 37 is comprised of a circular plate, at the center of which there is a circular hole, and the mixing tube 37 is inserted in this hole. A vertical lip 41*a* is formed around the globe supporting plate 41.

The globe supporting plate 41 is provided with four openings 41*b* equally spaced around the circular hole at the center, and a wire engagement member 42 is formed as the first means for wire engagement in each opening 41*b*. The wire engagement member 42 is constructed integrally with the globe supporting plate 41, by cutting away the component material of the globe supporting plate 41 around the wire engagement member.

Figure 4:
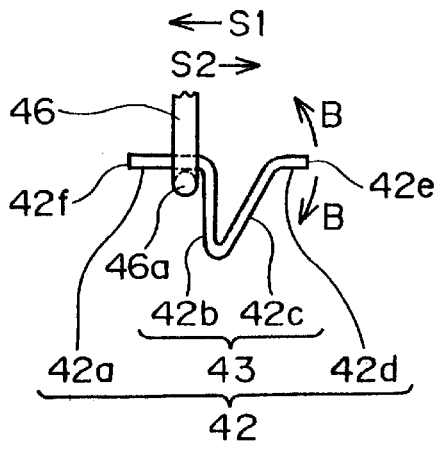
FIG. 4 is a cross-sectional view of the first means.

FIG. 4 shows a vertical section through the wire engagement member 42. The wire engagement member 42 is comprised of a first portion 42*a* that extends in an outward direction from the center of the globe supporting plate 41, a second portion 42*b* extending downwards from the first portion 42*a*, a third portion 42*c* that extends obliquely upwards from the second portion 42*b*, and a fourth portion 42*d* extending substantially horizontally from the third portion 42*c*; the second portion 42*b* and the third portion 42*c* constitute a protruding portion 43 directed downwards.

In addition, the globe supporting plate 41 as well as the wire engagement member 42 is made of a metal with resiliency, and the tip 42*e* of the fourth portion 42*d* of the wire engagement member 42 can rotate vertically about the end 42*f* of the first portion 42*a*, that is, in the direction shown by the arrow B. Therefore, by pushing the tip 42*e* of the wire engagement member 42 up or down, the protruding portion 43 rotates up or down.

As shown in FIG. 3, a hollow cylindrical globe 44 is mounted on the globe supporting plate 41. The globe 44 is supported on the globe supporting plate 41 as it engages with the inside of the vertical lip 41*a* created at the periphery of the globe supporting plate 41. The globe 44 is made of thin, transparent glass, and is open at both the upper and lower ends.

The globe 44 is fastened to the globe supporting plate 41 by the ventilator 45 and the wires 46. The ventilator 45 is composed of a cap-shaped component whose bottom is open, and two wires 46 are provided on the ventilator 45, opposite each other, and are permitted to rotate freely in the direction of the arrow C. Each wire 46 is substantially rectangular in shape, and its length is almost the same as or slightly greater than the height of the globe 44. More explicitly, the wires are shaped so that when the ventilator 45 is positioned at substantially the same height as that of the top of the globe 44, the lower portion 46*a* of the wire 46 can reach the bottom surface of the globe supporting plate 41. Mounting and removing the globe 44 are performed for the gas lantern 30 according to the embodiment of the present invention, as follows.

When the globe 44 is to be installed, first the globe 44 is engaged with the inside of the vertical lip 41*a* of the globe supporting plate 41, thereby the globe 44 is located on the globe supporting plate 41. Next, the ventilator 45 is placed on top of the globe 44, and the two wires 46 are rotated towards the bottom surface of the globe supporting plate 41 so that the two wires pass around the outside of the globe 44.

When the wires 46 have reached the bottom surface of the globe supporting plate 41, the wires 46 move along the fourth portion 42*d* and the third portion 42*c* of the wire engagement member 42. The protruding portion 43 comprising the second and third portions 42*b*, 42*c* of the wire engagement member 42 are thus pushed upwards by the wires 46, so by moving the wires 46 along the fourth and third portions 42*d*, 42*c*, the protruding portions 43 gradually rotate upwardly. Eventually as shown in FIG. 4, the lower portions 46*a* of the wires 46 moving in the direction of the arrow S1 override the protruding portions 43, and reach the first portions 42*a* of the wire engagement members 42 where the wires stop. During this operation, to reduce the time for the lower portions 46*a* of the wires 46 to override the protruding portions 43, it is preferable to push the protruding portions 43 up with the fingertips.

As described above, by engaging the two wires 46 respectively with the corresponding wire engagement members 42, the globe 44 is fixed on the globe supporting plate 41. FIG. 2 shows the state where the globe 44 has been fixed on the globe supporting plate 41 in the manner described above.

When the globe 44 is to be removed from the globe supporting plate 41, the protruding portion 43 of the wire engagement member 42 is pushed up with a fingertip, and the lower portion 46*a* of the wire 46 is made to override the protruding portion 43 in the direction of the arrow S2. As a result, the engagement of the wire 46 by the wire engagement member 42 is released, therefore the ventilator 45 and the globe 44 become free from the globe supporting plate 41.

In this embodiment, four wire engagement members 42 are provided on the globe supporting plate 41. However, it is not necessary to provide four members at all times. Instead, a minimum of two wire engagement members 42 can be incorporated opposite each other. When two wire engagement members 42 are provided, the wires 46 can only be engaged when they are aligned in one direction, but if four wire engagement members 42 are used, the wires 46 can be engaged when aligned in either of two directions.

Although the first means for wire engagement used in the aforementioned first embodiment of the present invention is comprised of a resilient metal, the first means for wire engagement can take another form, as follows.

Figure 5:
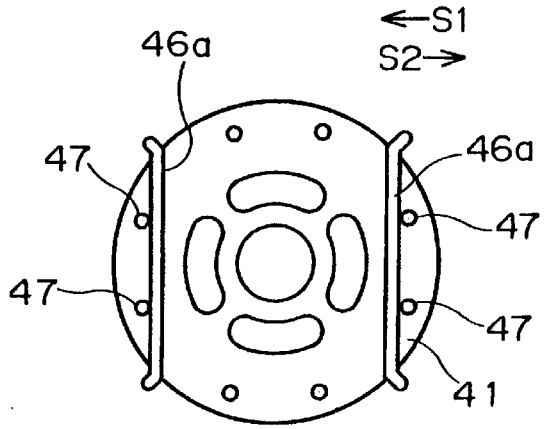
FIG. 5 is a bottom view of a globe supporting plate used in a gas lantern in accordance with the second embodiment in which the structure for supporting a globe in accordance with the present invention is employed.

FIG. 5 shows the first means used in the second embodiment of a gas lantern according to the present invention. FIG. 5 is a view of the bottom of the globe supporting plate 41 when the globe supporting plate 41 is viewed from below.

In the second embodiment, hemispherical convex bodies 47 are provided on the bottom surface of the globe supporting plate 41, in place of the wire engagement members 42. The convex bodies 47 are arranged in pairs, so a total of four pairs of convex bodies 47 are provided near the outer periphery of the globe supporting plate 41; pairs of convex bodies are arranged diametrically opposite another pair such that their axes of symmetry are orthogonal.

Also with this embodiment, the globe 44 is fixed on the globe supporting plate 41 when the end portions 46*a* of the wires 46 override the convex bodies 47 in the direction of the arrow S1 and stop in the place shown in FIG. 5. For the reverse operation, when the end portions 46*a* of the wires 46 override the convex bodies 47 in the direction of the arrow S2, engagement between the wires 46 and the convex bodies 47 is released, so that the globe 44 and the ventilator 45 become free from the globe supporting plate 41.

However, the shape of the projections 47 is not limited to a hemisphere, and the projections may have other shapes. The projections 47 are not limited to a pair. In other arrangements, the projections 47 can be formed individually or combined into groups each of which is comprised of three or more projections 47. In addition, it is not always necessary to provide four pairs of the projections 47, and a minimum of two opposite pairs of the projections 47 is sufficient.

Figure 6:
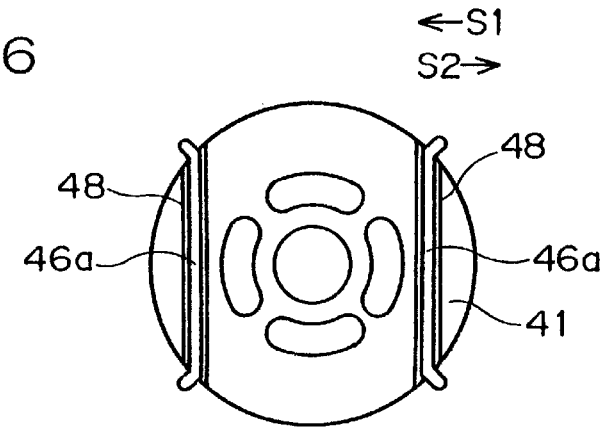
FIG. 6 is a bottom view of a globe supporting plate used in a gas lantern in accordance with the third embodiment in which the structure for supporting a globe in accordance with the present invention is employed.

FIG. 6 illustrates the first means for wire engagement used in the third embodiment of the present invention for a gas lantern. FIG. 6 shows a bottom view of the globe supporting plate 41 when the plate is viewed from below.

This embodiment incorporates the first means for wire engagement including two grooves 48 each of which has a semi-circular cross section, formed on the bottom surface of the globe supporting plate 41, instead of the wire engagement members 42. The grooves 48 are parallel to each other and a predetermined distance apart.

Also in this embodiment, the globe 44 is fixed on the globe supporting plate 41 when the end portions 46*a* of the wires 46 engage with the grooves 48 in the direction of the arrow S1. When the end portions 46*a* of the wires 46 are disengaged from the grooves 48 in the direction of the arrow S2, on the other hand, engagement between the wires 46 and the grooves 48 is released, so that the globe 44 and the ventilator 45 become free from the globe supporting plate 41.

Figure 7:
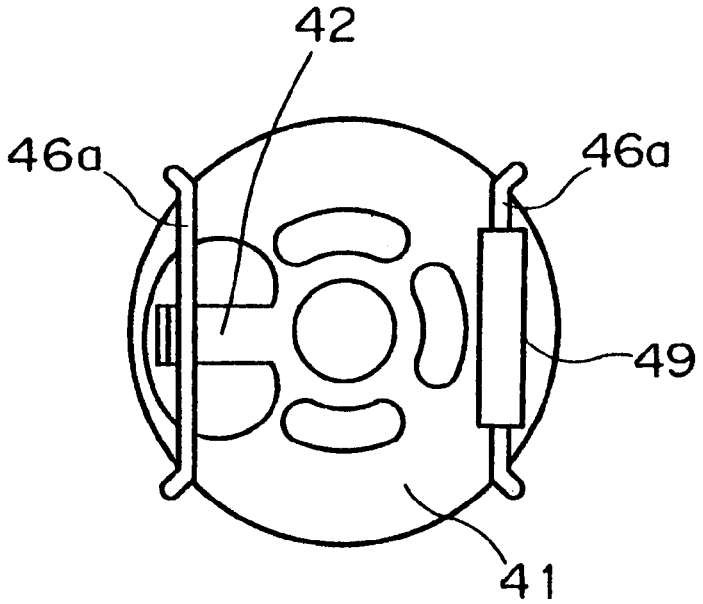
FIG. 7 is a bottom view of a globe supporting plate used in a gas lantern in accordance with the fourth embodiment in which the structure for supporting a globe in accordance with the present invention is employed.

FIG. 7 indicates the first means for wire engagement used in the fourth embodiment of the present invention for a gas lantern. FIG. 7 shows a view of the bottom of the globe supporting plate 41 when the globe supporting plate 41 is viewed from below.

In this embodiment, the first means for wire engagement is comprised of one wire engagement member 42 used in the above-mentioned first embodiment, and a cylindrical wire fixing tube 49 fixed on the bottom surface of the globe supporting plate 41. One of the two wires 46 is installed in the wire fixing tube 49 attached to the globe supporting plate 41 in a freely rotatable manner. That is, one of the wire 46 is fixed to the globe supporting plate 41, and cannot be removed from the plate.

In this embodiment, because one of the wire 46 is fixed to the globe supporting plate 41, the globe 44 can be mounted on or removed from the globe supporting plate 41, by engaging the other wire 46 with or releasing its engagement with the wire engagement member 42, respectively.

Using this embodiment, engagement between the wires 46 and the first means for wire engagement can be released by disengaging only one set of the wire 46 and its related means of engagement, so the globe 44 can be removed efficiently from the globe supporting plate 41. Because the ventilator 45 is permanently attached to the globe supporting plate 41 in the embodiment, the ventilator 45 can be prevented from being misplaced after being removed from the globe supporting plate 41.

Figure 8:
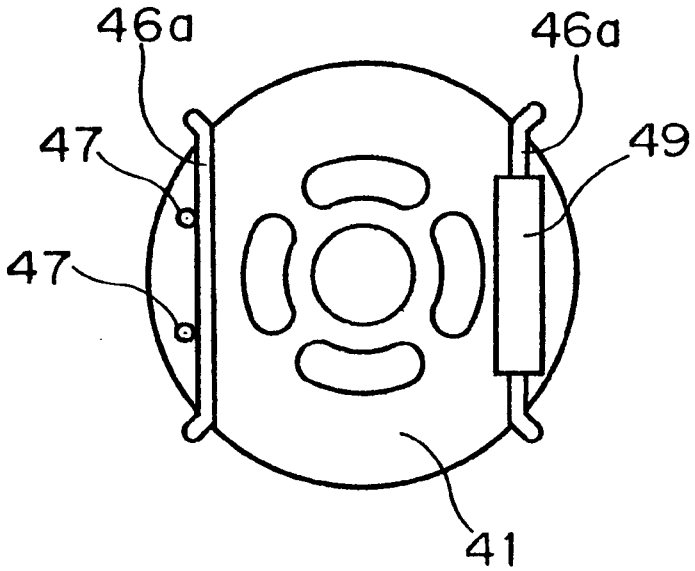
FIG. 8 is a bottom view of a globe supporting plate used in a gas lantern in accordance with the fifth embodiment in which the structure for supporting a globe in accordance with the present invention is employed.

FIG. 8 shows the first means for wire engagement used in the fifth embodiment of the present invention in a gas lantern. FIG. 8 is a view of the bottom of the globe supporting plate 41 viewed from below.

The embodiment is an example of using projections 47 as the first means for wire engagement, instead of the wire engagement member 42 shown in FIG. 7. Although not illustrated, it is possible to form the grooves 48 shown in FIG. 6, in place of the projections 47 shown in FIG. 8 as the first means for wire engagement.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-266587 filed on Sep. 30, 1997 including specification, claims, drawings and summary is incorporated herein by reference in its entirety.

What is claimed is:

1. A globe supporting structure that supports a globe of a gas lantern which burns combustible gas discharged from a gas cartridge containing said combustible gas by means of a burner head located inside said globe, comprising:

a ventilator positioned above said globe;

a plurality of wires rotatably arranged on said ventilator, each of which rotates about said ventilator, and is shaped so as to be capable of reaching a bottom surface of said globe; and a globe supporting plate that supports said globe, and is provided with first means which is detachably engagable with a portion of said wires reaching said bottom surface of said globe.

2. The globe supporting structure as set forth in claim 1, wherein said first means is provided with a protruding portion that protrudes downward, and can rotate in a vertical direction.

3. The globe supporting structure as set forth in claim 2, wherein said first means is made of a resilient material.

4. The globe supporting structure as set forth in claim 2, wherein said first means comprises a portion of said globe supporting plate, said portion being formed by cutting away a peripheral part of said globe supporting plate.

5. The globe supporting structure as set forth in claim 3, wherein the first means comprises a portion of the globe supporting plate, the portion being formed by cutting away a peripheral part of the globe supporting plate.

6. The globe supporting structure as set forth in claim 1, wherein the first means comprises at least one projection formed on a lower surface of the globe supporting plate.

7. The globe supporting structure as set forth in claim 1, wherein the first means comprises a recess that is formed on the lower surface of the globe supporting plate, and to which the wires are engaged.

8. The globe supporting structure as set forth in claims 1, wherein a plurality of wires are paired, and a wire of each pair is rotatably supported on the lower surface of the globe supporting plate.

9. The globe supporting structure as set forth in claim 1, wherein two of the wires are installed facing the ventilator, and two of the first means are formed on the globe supporting plate so as to be associated with the two of the wires.

* * * * *